US007886912B2

(12) United States Patent
Bourke

(10) Patent No.: US 7,886,912 B2
(45) Date of Patent: Feb. 15, 2011

(54) AUXILIARY AGITATOR FOR A FLOTATION DEVICE

(75) Inventor: Peter Gerard Bourke, Western Australia (AU)

(73) Assignee: Outotec Oyj, Espoo (FI)

( * ) Notice: Subject to any disclaimer, the term of this patent is extended or adjusted under 35 U.S.C. 154(b) by 1329 days.

(21) Appl. No.: 10/549,725

(22) PCT Filed: Mar. 16, 2004

(86) PCT No.: PCT/AU2004/000315

§ 371 (c)(1),
(2), (4) Date: Sep. 16, 2005

(87) PCT Pub. No.: WO2004/082841

PCT Pub. Date: Sep. 30, 2004

(65) Prior Publication Data

US 2006/0249432 A1 Nov. 9, 2006

(30) Foreign Application Priority Data

Mar. 17, 2003 (AU) ..... 2003901207

(51) Int. Cl.
*B03D 1/16* (2006.01)
*B03D 1/22* (2006.01)

(52) U.S. Cl. ..... 209/169; 261/87

(58) Field of Classification Search ..... 209/169; 261/87

See application file for complete search history.

(56) References Cited

U.S. PATENT DOCUMENTS 2,182,442 A 12/1939 Booth (Continued)

FOREIGN PATENT DOCUMENTS

AU 199924989 A1 11/2000

(Continued)

OTHER PUBLICATIONS

Chilean Search Report for corresponding Chilean Patent Application No. CL-2270-02.

(Continued)

*Primary Examiner*—Thomas M Lithgow
(74) *Attorney, Agent, or Firm*—Fish & Richardson P.C.

(57) ABSTRACT

The invention provides an agitator (1) is disposed to agitate slurry within a flotation tank (2). The agitator includes a rotor (6) mounted on one end of a centrally disposed drive shaft (7) extending axially downwardly into the tank and driven by a motor (8) and associated gearbox (not shown). The other end of the drive shaft includes a mounting flange (9) adapted for connection to the motor. A stator (10) is also provided around the rotor. A froth deflection cone (11) extends around the drive shaft adjacent the top of the tank. The deflection cone is oriented such that its smallest diameter is located at its lowermost end nearest the rotor (6). An auxiliary agitator (12) is connected to the drive shaft at a position substantially midway between the underside of the deflection cone (11) and the top of the rotor (6), as shown in FIG. 1 and FIG. 2. The auxiliary agitator (12) includes agitation blades (13) extending radially outwardly from diametrically opposite sides of the shaft (7). Each blade (13) intersects the shaft at an angle of incidence of around 45 degrees to the shaft axis (14).

35 Claims, 3 Drawing Sheets

U.S. PATENT DOCUMENTS

| | | | | | |
|---|---|---|---|---|---|
| 2,232,388 | A | * | 2/1941 | Ingalls et al. | 209/169 |
| 2,573,521 | A | * | 10/1951 | Wasley et al. | 261/93 |
| 2,600,408 | A | * | 6/1952 | Komarek | 366/300 |
| 2,628,827 | A | * | 2/1953 | Daman | 261/87 |
| 2,651,413 | A | | 9/1953 | Daman | |
| 2,673,724 | A | * | 3/1954 | Potts | 261/87 |
| 2,973,095 | A | * | 2/1961 | Sayers et al. | 209/169 |
| 4,478,515 | A | * | 10/1984 | Tobin | 366/67 |
| 5,286,107 | A | | 2/1994 | Artusi | |
| 5,326,168 | A | | 7/1994 | Miura | |
| 5,607,235 | A | * | 3/1997 | Campbell | 366/325.2 |
| 5,909,022 | A | * | 6/1999 | Bourke et al. | 209/164 |
| 5,947,599 | A | | 9/1999 | Funk | |
| 6,109,449 | A | | 8/2000 | Howk et al. | |

FOREIGN PATENT DOCUMENTS

| | | | |
|---|---|---|---|
| CL | 2270-02 | | 3/2002 |
| CL | 2270-02 | | 7/2003 |
| EP | 0 754 489 | A1 | 1/1997 |
| RU | 23581 | | 6/2002 |
| RU | 2187380 | | 8/2002 |
| SU | 59342 | | 3/1941 |
| SU | 1250724 | | 8/1986 |
| SU | 1258492 | | 9/1986 |
| SU | 1378777 | | 2/1988 |
| SU | 1563582 | | 5/1990 |
| SU | 1811422 | | 4/1993 |
| WO | WO 01/39872 | A1 | 6/2001 |
| WO | WO 0143881 | A1 * | 6/2001 |

OTHER PUBLICATIONS

Chilean Search Report for corresponding Chilean Patent Application No. CL-2270-02.

Supplementary Partial European Search Report cited in European Application No. EP 04720832, date of Communication: Jul. 6, 2006.

* cited by examiner

AUXILIARY AGITATOR FOR A FLOTATION DEVICE

This application is the national phase application under 35 U.S.C. §371 of International Application No. PCT/AU2004/000315 filed on Mar. 16, 2004, entitled, "AUXILIARY AGITATOR FOR A FLOTATION DEVICE" which claims the benefit of Australian Patent Application No. 2003901207 filed on Mar. 17, 2003.

FIELD OF THE INVENTION

The present invention relates to flotation devices of the type used in mineral separation and will be described hereinafter with reference to this application. However, it will be appreciated that the invention is not limited to this particular field of use.

BACKGROUND OF THE INVENTION

The following discussion of the prior art is provided to enable the invention to be placed in an appropriate technical context, and to facilitate an appreciation of the advantages that flow from it. However, references to prior art should in no way be considered as an admission that such prior art is widely known or forms part of common general knowledge in the field.

Conventional flotation devices typically include a tank to receive and contain slurry from a grinding mill, a cyclone separator, or the like. An agitator, comprising a rotor housed within a stator, is normally disposed within the tank to agitate the slurry. An aeration system is also provided to direct air under pressure into the agitator through a central conduit formed within the drive shaft. Suitable reagents are also added, which coat the surfaces of the mineral particles within the slurry to make the particles hydrophobic so as to preferentially promote bubble to particle attachment. As bubbles dispersed by the rotor rise toward the surface of the tank, they carry with them floatable valuable mineral particles, which form a mineral enriched surface froth. The froth then migrates over a lip and into a launder whereby the valuable mineral particles suspended in the froth are recovered from the tank as a mineral concentrate. The gangue particles remaining suspended in the slurry, along with those mineral particles not removed by flotation, are discharged from the tank through a bottom outlet. The bottom outlet often incorporates a dart or pinch valve, which is opened to allow the remaining slurry to progress under gravity feed to downstream treatment processes. An automatic control system, typically incorporating a liquid level sensor and a PID controller, regulates a control valve to maintain a substantially constant liquid level in the tank. The rotor disclosed in U.S. Pat. No. 4,078,026 is an example of a rotor that is used in prior art devices in this field.

As flotation devices increase in size, the agitation input energy must increase proportionally. Moreover, for a large flotation device to maintain efficiency, it must be capable of achieving a similar flotation kinetic rate as that achieved by a group of smaller cells of the same total volume.

In recent years, the size of flotation devices has increased, primarily for economic reasons. However, the design of such devices has remained relatively unchanged. Accordingly, for the reasons mentioned above, these large flotation devices are often not optimised in terms of flotation efficiency.

It is therefore an object of the present invention to overcome or substantially ameliorate one or more of the disadvantages of the prior art, or at least to provide a useful alternative.

SUMMARY OF THE INVENTION

Accordingly, a first aspect of the invention provides an auxiliary agitator for a flotation device of the type having a tank, a primary agitator including a primary rotor, drive means, and a drive shaft disposed intermediate the drive means and the primary rotor, the auxiliary agitator including:

an auxiliary agitation blade adapted, in use, to supplement an axial flow induced in the tank by the primary rotor; and connecting means for connecting the blade to the drive shaft intermediate the drive means and the primary rotor.

Preferably, the angle of incidence is constant along the length of the blade, as in an axial impeller, at between 15 degrees and around 75 degrees with respect to the direction of travel of the blade. Alternatively, the angle of incidence varies along the length of the blade, as in a propeller. In another embodiment, the pitch of the blade is adjustable depending on specific system parameters, such as slurry density, slurry viscosity or flow characteristics within the tank.

Preferably, the blade includes a substantially straight leading edge. However, in alternative embodiments, the leading edge may be curved.

Preferably, the blade is releasably connected to the shaft to allow its position along the shaft to be adjusted. However, the blade is preferably connected to the shaft at around the mid-height of the tank.

Preferably, the connecting means include a clamp. More preferably, the clamp is formed of two inter-engageable clamping halves. More preferably, the two clamping halves are substantially identical. Even more preferably, inner walls of the clamp together define a generally cylindrical clamping surface. Alternatively, the connecting means take the form of welds or bolts.

Preferably, the agitator includes a resilient protective layer coating its exterior surfaces. More preferably, the layer is greater than 3 mm thick. Even more preferably, the layer is between around 5 mm and around 7 mm thick.

Preferably, the agitator includes a pair of the auxiliary blades, in use extending radially outwardly from diametrically opposite sides of the shaft, each blade having associated connecting means. Alternatively, the agitator includes at least three of the blades, in use equally spaced around the perimeter of the shaft, each blade having associated connecting means.

Preferably, in use, each blade intersects the shaft at an angle of incidence of around 45 degrees.

According to a second aspect, the invention provides agitation means for a flotation device of the type previously defined, said agitation means including:

a drive shaft;

a primary rotor connected to one end of the drive shaft to form the primary agitator; and an auxiliary agitator as defined above.

Preferably, the agitation blade is releasably connected to the shaft to allow its position along the shaft to be adjusted. However, the blade is preferably located substantially at the midpoint of the drive shaft.

Preferably, the agitation means are suitable for use in a three phase environment including water, solids and air.

According to a third aspect, the invention provides a flotation device including:

a tank for containing slurry incorporating minerals to be extracted, a feed inlet for admission of slurry into the tank;

agitation means, as defined above, to agitate the slurry within the tank; and aeration means to aerate the slurry whereby floatable minerals in suspension form a surface froth.

Preferably, a stator surrounds the rotor.

Preferably, a peripheral overflow launder extends around the inside top of the tank for recovering mineral enriched froth from the surface.

Preferably, the aeration means include an air blower and a fluid conduit for directing air from the blower into the rotor. More preferably, the conduit includes an axial bore extending through the drive shaft. Alternatively, the conduit is disposed to direct air into the rotor from underneath.

Preferably, the flotation device includes a froth deflection cone extending around the drive shaft adjacent the top of the tank, the smallest diameter of the cone being at its lowermost end nearest the rotor. More preferably, the deflection cone is disposed to deflect froth outwardly toward the overflow launder as it migrates toward the surface of the tank. Even more preferably, the deflection cone is disposed to prevent vortexing at the tank surface.

Preferably, the auxiliary agitator is adapted for use in a flotation device having a tank with a capacity of at least 50 $m^3$.

BRIEF DESCRIPTION OF THE DRAWINGS

A preferred embodiment of the invention will now be described, by way of example only, with reference to the accompanying drawings, in which.

PREFERRED EMBODIMENTS OF THE INVENTION

Figure 1:
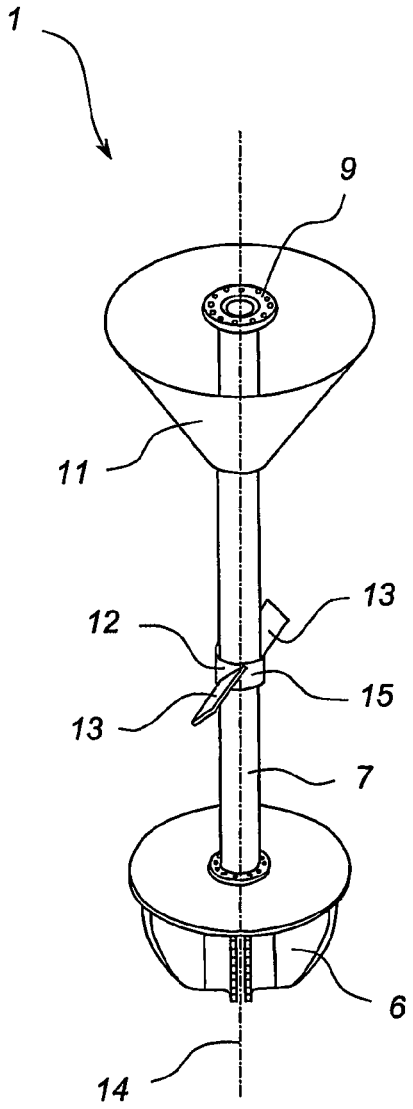
FIG. 1 is a perspective view of an agitator incorporating agitation means according to the invention.

Referring to the drawings, there is shown an agitator 1 for a flotation tank 2, which tank contains a slurry incorporating minerals to be extracted. The illustrated tank includes a generally flat base 3 and a substantially cylindrical sidewall 4 extending upwardly from the base. However, it will be appreciated that in alternative embodiments, tanks of other shapes and sizes are used. A peripheral overflow launder 5 extends around the inside top of the sidewall for removing mineral enriched froth as it floats to the surface.

The agitator 1 is disposed to agitate the slurry within the tank. The agitator includes a rotor 6 mounted on one end of a centrally disposed drive shaft 7 extending axially downwardly into the tank and driven by a motor 8 and associated gearbox (not shown). The other end of the drive shaft includes a mounting flange 9 adapted for connection to the motor. A stator 10 is also provided around the rotor.

A froth deflection cone 11 extends around the drive shaft adjacent the top of the tank. The deflection cone is oriented such that its smallest diameter is located at its lowermost end nearest the rotor 6.

Figure 2:
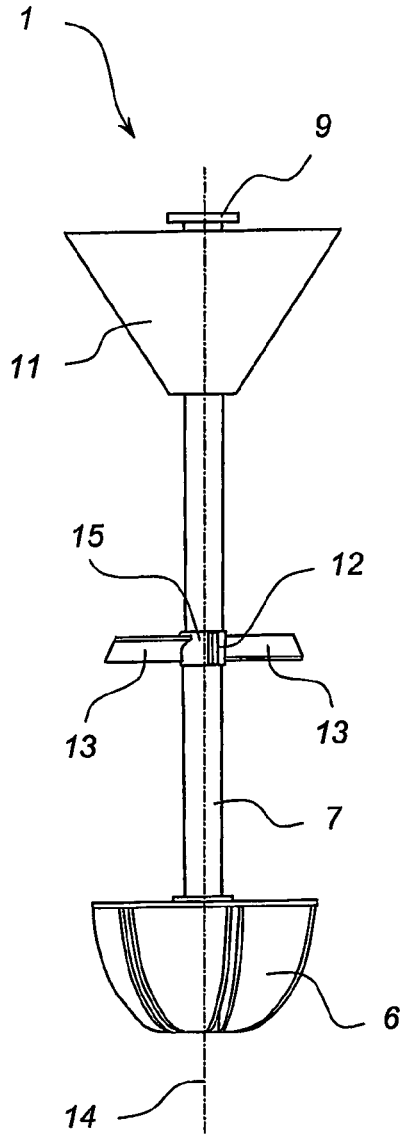
FIG. 2 is a side view of the agitator of FIG. 1.
Figure 3:
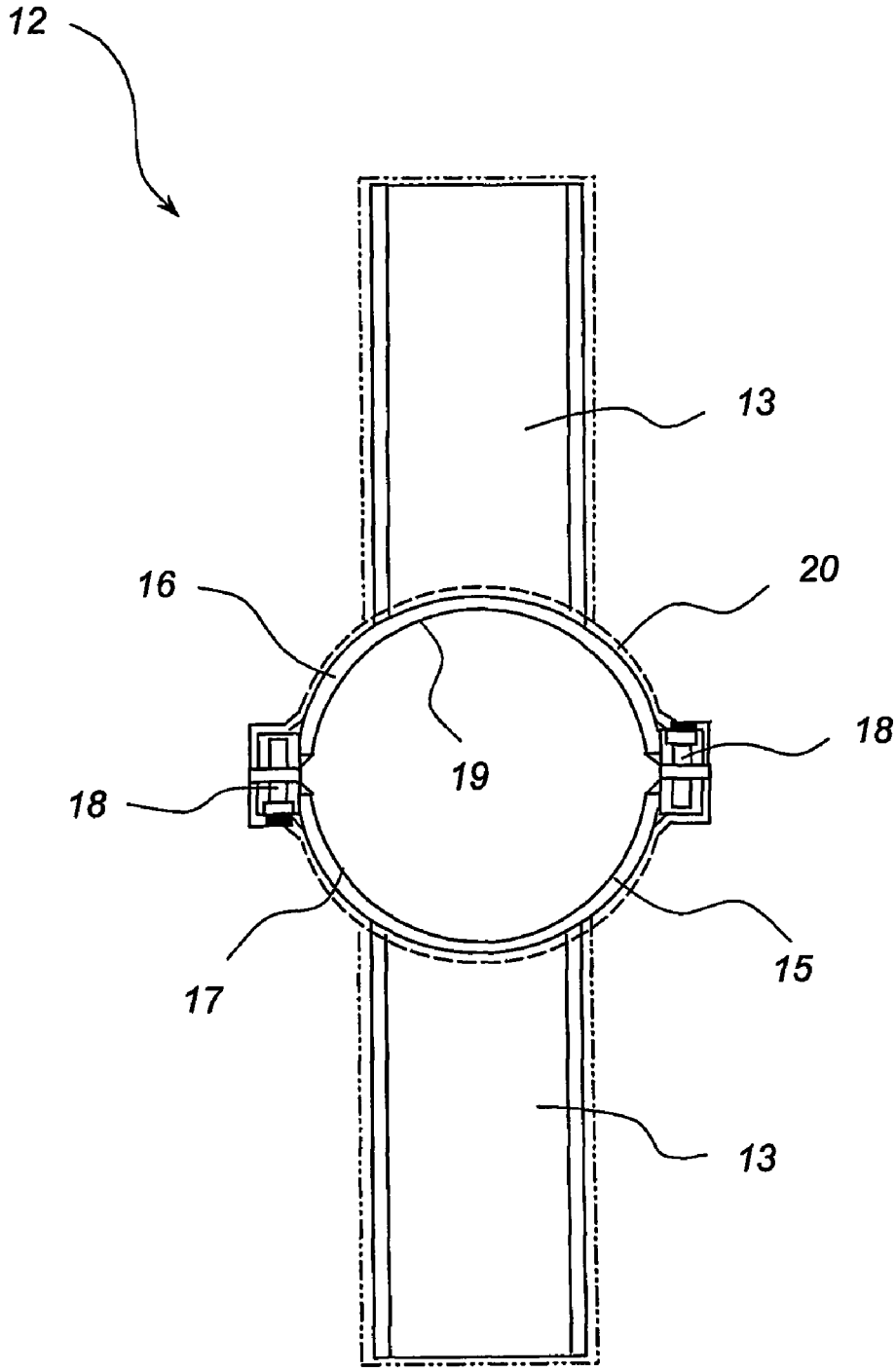
FIG. 3 is a top view of an auxiliary agitator according to the invention.
Figure 4:
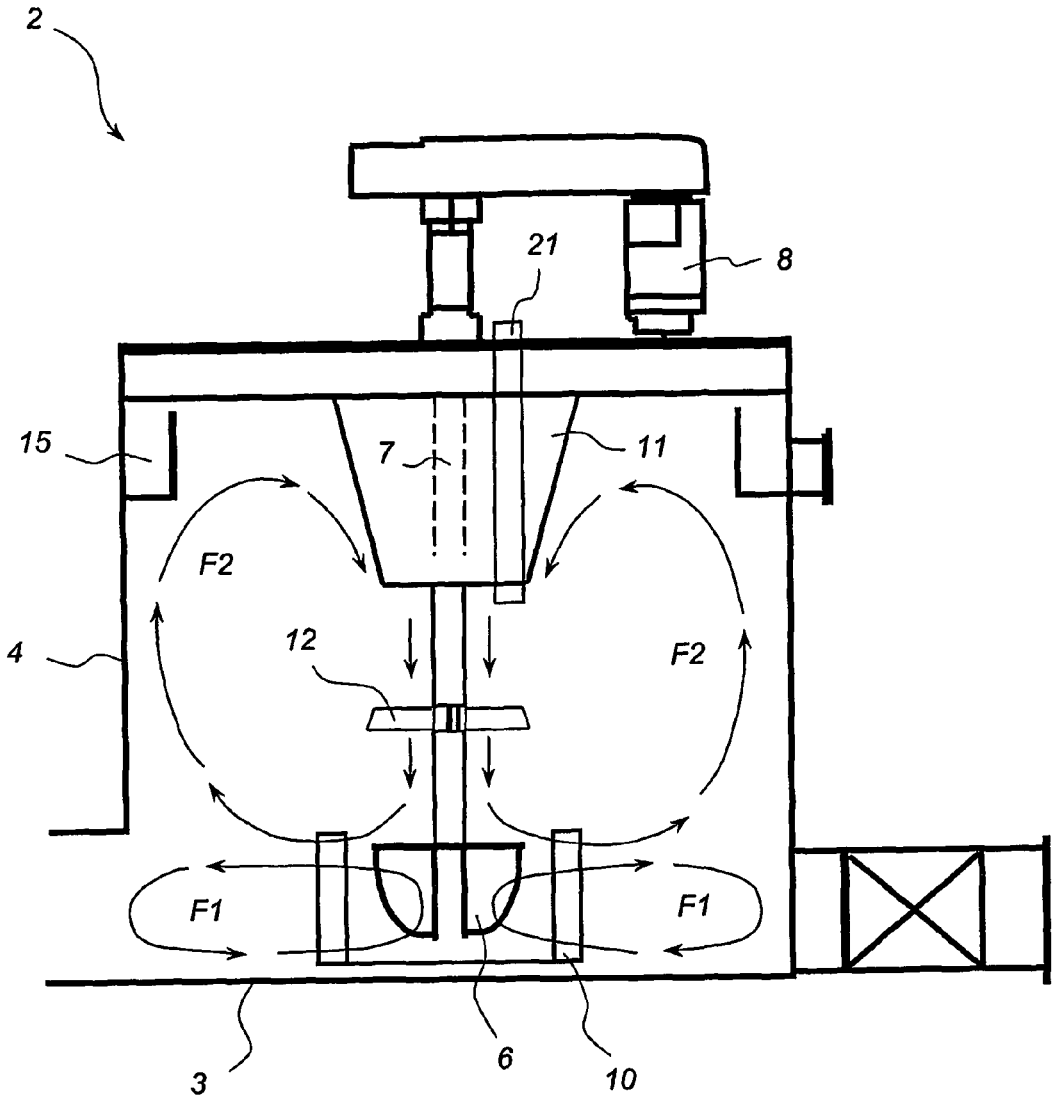
FIG. 4 is a sectional side view of a typical flotation device incorporating the agitator.

An auxiliary agitator 12 is connected to the drive shaft at a position substantially midway between the underside of the deflection cone 11 and the top of the rotor 6, as shown in FIG. 1 and FIG. 2. The auxiliary agitator 12 includes agitation blades 13 extending radially outwardly from diametrically opposite sides of the shaft 7. Each blade 13 intersects the shaft at an angle of incidence of around 45 degrees to the shaft axis 14.

The blades 13 are connected to the shaft 7 by a clamp 15. The clamp is formed from two clamping halves 16 and 17 secured together by bolts 18 and each including one blade 13. The inner walls of the clamp define a cylindrical clamping surface 19.

A 6 mm rubber coating 20 is provided on the outer surfaces of the auxiliary agitator to protect it from chemical and mechanical abrasion.

In use, the agitation blades 13 define an axial impeller to supplement an axial flow induced in the tank by the primary rotor 6. The diameter of the impeller is around 15% to 35% of the diameter of the flotation tank.

An aeration system including an air blower and a fluid conduit (not shown) is also provided to direct air from the blower into the rotor 6. The conduit is defined in part by an axial bore (not shown) extending through the rotor drive shaft 7.

In use, the rotor 6 induces a primary flow through the slurry as indicated by arrows F1. The primary flow continuously recirculates the slurry at the bottom of the tank to maintain the particles in suspension. The aeration system continuously disperses air into the rotor to form fine bubbles, which collide with and adhere to the valuable mineral particles in the slurry and subsequently float to the top of the tank to form a mineral enriched surface froth. As the froth floats toward the surface, it is directed radially outwardly by the deflection cone 11 for recovery through the overflow launder 5.

The primary rotor 6 also induces a secondary flow through the slurry as indicated by arrows F2. However, as flotation devices increase in size, the secondary flow induced by the primary rotor reduces. Accordingly, it has been found that when floatable particles drop out of the froth zone at the tank surface, the secondary flow induced by the primary rotor alone is often not sufficient to draw these particles back into the mixing zone of primary rotor for refloating, thereby reducing the cell efficiency. This problem is particularly relevant in flotation devices of capacity greater than around 150 $m^3$ to 200 $m^3$ or larger.

The auxiliary agitator 12 increases the secondary flow, F2, in large flotation devices to an extent comparable to that of a group of smaller cells of equivalent total volume. It achieves this by inducing a downward current, which increases the secondary flow turnover rate. This, in turn, draws floatable particles that have dropped out of the froth zone down through the tank and into the mixing zone of the primary rotor, thereby increasing the probability that these particles will be refloated, and hence increasing the overall efficiency of the recovery process. In addition, the auxiliary rotor also facilitates dispersion of reagents added to the slurry through a reagent addition tube 21 extending downwardly through the deflection cone 11. This effect occurs primarily because of the increased downward pumping action induced by the auxiliary agitator, which forces the reagent enriched pulp downwards into the primary rotor for reflotation. It will be appreciated that the invention thereby provides both practical and commercially significant advantages over the prior art.

It will be appreciated that in other embodiments many components of the flotation device described above may be substituted with suitable alternatives. For example, the auxiliary agitator can be connected to the drive shaft by other means, such as welds or bolts. Also, the coating provided on the outer surfaces of the auxiliary agitator may be formed from an alternative material such as polyethylene and may also be of a different thickness. In one embodiment, the auxiliary agitator includes a curved leading edge, similar to that on a propeller. The auxiliary agitator can also be shaped to have a variable angle of incidence along its length. Moreover, while the invention has been described with reference to conventional flotation cells, it will be appreciated that the same principles may be applied to other flotation cells, such as flash flotation cells, or Skim Air cells.

Although the invention has been described with reference to specific examples, it will be appreciated by those skilled in the art that the invention may be embodied in many other forms.

The invention claimed is:

1. A flotation device comprising:

a tank for containing slurry incorporating minerals to be extracted;

a feed inlet for admission of slurry into the tank;

an agitator to agitate the slurry within the tank comprising a drive mechanism, a primary rotor connected to the drive mechanism by a drive shaft, and an auxiliary agitation blade, the primary rotor being adapted to induce a primary fluid flow and a secondary fluid flow above the primary fluid flow within the tank, and the auxiliary agitation blade being disposed for coaxial rotation above the primary rotor to induce axial fluid flow in a downward direction, thereby to supplement the secondary flow induced by the primary rotor; and an aerator comprising an air blower and a fluid conduit for directing air from the blower into the primary rotor so as to aerate the slurry whereby floatable minerals in suspension form a surface froth in the tank.

2. The flotation device according to claim 1, wherein said auxiliary agitation blade induces substantially only axial flow in a downward direction.

3. The flotation device according to claim 2, wherein the auxiliary agitation blade, in use, acts as an axial impeller to supplement an axial secondary fluid flow of the primary rotor.

4. The flotation device according to claim 2, wherein the auxiliary agitation blade is part of an axial impeller.

5. The flotation device according to claim 1, wherein the auxiliary agitation blade defines an angle of incidence that is substantially constant along the length of the blade.

6. The flotation device according to claim 5, wherein the angle of incidence is between 15 degrees and around 75 degrees with respect to the direction of travel of the auxiliary agitation blade.

7. The flotation device according to claim 1, wherein the auxiliary agitation blade defines an angle of incidence that varies along the length of the blade.

8. The flotation device according to claim 1, wherein the pitch of the auxiliary agitation blade is adjustable depending on specific system parameters.

9. The flotation device according to claim 8, wherein the specific system parameters include slurry density, slurry viscosity and flow characteristics within the tank.

10. The flotation device according to claim 1, wherein the auxiliary agitation blade comprises a substantially straight leading edge.

11. The flotation device according to claim 1, wherein the leading edge of the auxiliary agitation blade is curved.

12. The flotation device according to claim 1, wherein the auxiliary agitation blade is releasably connected to the drive shaft to allow its position relative to the primary rotor to be adjusted.

13. The flotation device according to claim 1, wherein, in use, the auxiliary agitation blade is connected to the shaft at around a midheight of the tank.

14. The flotation device according to claim 1, wherein the auxiliary agitation blade is connected to the drive shaft for conjoined rotation with the primary rotor.

15. The flotation device according to claim 1, wherein the auxiliary agitation blade is connected to the drive shaft by at least one of a clamp, welds and bolts.

16. The flotation device according to claim 15, wherein the clamp is formed of two inter-engageable clamping halves.

17. The flotation device according to claim 15, wherein inner walls of the clamp together define a generally cylindrical clamping surface.

18. The flotation device according to claim 1, wherein the auxiliary agitation blade comprises a resilient protective layer coating its exterior surfaces.

19. The flotation device according to claim 18, wherein the protective layer is greater than around 3 mm thick.

20. The flotation device according to claim 18, wherein the protective layer is between around 5 mm and around 7 mm thick.

21. The flotation device according to claim 1, comprising a pair of said auxiliary agitation blades, which in use extend radially outwardly from diametrically opposite sides of the drive shaft.

22. The flotation device according to claim 1, comprising at least three of said auxiliary agitation blades, which in use are equally spaced around the perimeter of the drive shaft.

23. The flotation device according to claim 21 or 22, wherein, in use, each auxiliary agitation blade intersects the shaft at an angle of incidence of around 45 degrees.

24. The flotation device according to claim 1, wherein the fluid conduit comprises an axial bore extending through the drive shaft.

25. The flotation device according to claim 1, wherein the fluid conduit is disposed to direct air into the rotor from underneath.

26. The flotation device according to claim 1, comprising a stator surrounding the rotor.

27. The flotation device according to claim 1, wherein the agitator is adapted for use in a three phase environment comprising water, solids and air.

28. The flotation device according to claim 1, comprising a froth deflection cone extending around the drive shaft adjacent the top of the tank, the smallest diameter of the cone being at its lowermost end nearest the rotor.

29. The flotation device according to claim 28, comprising a peripheral overflow launder extending around the inside top of the tank and wherein the deflection cone is disposed to deflect froth outwardly toward the overflow launder for recovering mineral enriched froth from the surface of the tank.

30. The flotation device according to claim 28, wherein the deflection cone is disposed to prevent vortexing at the tank surface.

31. The flotation device according to claim 28, wherein the auxiliary agitation blade is located substantially midway between the top of the rotor and the bottom of the deflection cone.

32. The flotation device according to claim 28, comprising a reagent addition tube extending downwardly into the tank through the deflection cone.

33. The flotation device according to claim 1, adapted for agitating a slurry containing up to around 55% solids.

34. The flotation device according to claim 1, wherein the tank has a capacity of at least 50 $m^3$.

35. The flotation device according to claim 1, wherein said auxiliary agitation blade has a diameter of around 15% to around 35% of the tank diameter.

* * * * *